United States Patent [19]

Cole, Jr.

[11] 4,207,202

[45] Jun. 10, 1980

[54] APPARATUS FOR MAKING SMALL BUBBLE FOAM

[76] Inventor: Howard W. Cole, Jr., 12 Vale Dr., Mountain Lakes, N.J. 07046

[21] Appl. No.: 912,219

[22] Filed: Jun. 5, 1978

[51] Int. Cl.[2] ..... B01F 3/04; B01F 5/06

[52] U.S. Cl. ..... 252/359 E; 261/DIG. 26; 366/337; 366/340; 422/133; 422/135

[58] Field of Search ..... 252/359 E; 261/DIG. 28, 261/DIG. 26; 366/336, 337, 338, 340; 23/288 FB, 288 FU; 422/133, 224

[56] References Cited

U.S. PATENT DOCUMENTS

| | | | |
|---|---|---|---|
| 2,532,565 | 12/1960 | Miller | 261/DIG. 26 |
| 3,388,868 | 6/1968 | Watson | 261/DIG. 26 |
| 3,785,620 | 1/1974 | Huber | 366/340 |
| 3,785,781 | 1/1974 | Hervert et al. | 23/288 FC |
| 3,925,252 | 12/1975 | Yabata | 23/288 FC |
| 3,965,975 | 6/1976 | Edmandson | 366/336 X |
| 3,983,903 | 10/1976 | Kuehn Jr. | 138/37 |
| 4,000,992 | 1/1977 | Cole, Jr. | 261/DIG. 26 |
| 4,067,696 | 1/1978 | Curtis | 261/DIG. 28 |
| 4,068,830 | 1/1978 | Gray | 366/340 |
| 4,078,898 | 3/1978 | Fedor | 23/288 FB |

*Primary Examiner*—Michael S. Marcus

*Attorney, Agent, or Firm*—Roy C. Hopgood; John M. Calimafde; Charles W. Neill

[57] ABSTRACT

Apparatus for making foam from water, air and surfactant produces very small bubble foam by discharging the ingredients for the foam through passages that cause the stream of ingredients to be alternately expanded and contracted as by travel along tortuous passages to generate the foam. The foam may be delivered to pipes of relatively large diameter to a place of use, particularly for dust suppression. A more uniform flow of foam is obtained as compared with foamers of the prior art where the foam sometimes broke up into alternating slugs of foam and air when discharged from pipes of large enough diameter to cause the foam to travel at low velocity.

13 Claims, 12 Drawing Figures

PUMP
FLOW

APPARATUS FOR MAKING SMALL BUBBLE FOAM

BACKGROUND AND SUMMARY OF THE INVENTION

The new foamer of this invention advances the foam-making ingredients (water, air and surfactant) through a foamer with ingredients subjected to alternating pressure and expansion of the mixture of ingredients.

The mixture passages are tortuous, and in the preferred embodiment, by alternating increase and decrease in cross-section so that the mixture is successively expanded and contracted to facilitate the foam generation. The ingredients of the foam may be supplied to the upstream end of the foamer at uniform pressure to passages in the foamer, and these passages have a preferred construction of circles of subpassages that are in generally annular groups in which the inside and outside radii of the annulus alternately increases and decreases in diameter while the radial distance between the inner and outer circumferences of the annuli remain substantially unchanged.

As an annulus decreases in diameter, its cross-section becomes less, and the foam ingredients increase in velocity. This increase in velocity reduces the pressure in the fluid stream. At places where the annulus increases in cross-section, the velocity of the foam ingredients is reduced with resulting increase in the pressure in the fluid stream. This alternating decrease and increase in the pressure in the fluid stream generates the foam.

Foam made in the improved foamer of this invention can be delivered through pipes as long as 200 feet and at low velocity without breaking up into alternating slugs of foam and air as occurred with foamers of the prior art.

Other objects, features and advantages of the invention will appear or be pointed out as the description proceeds.

BRIEF DESCRIPTION OF DRAWING

In the drawing, forming a part hereof, in which like reference characters indicate corresponding parts in all the views.

DESCRIPTION OF PREFERRED EMBODIMENT

Figures 1, 2, 3, 4, 5, 6, 7, 8, 9, 10, 11, 12:
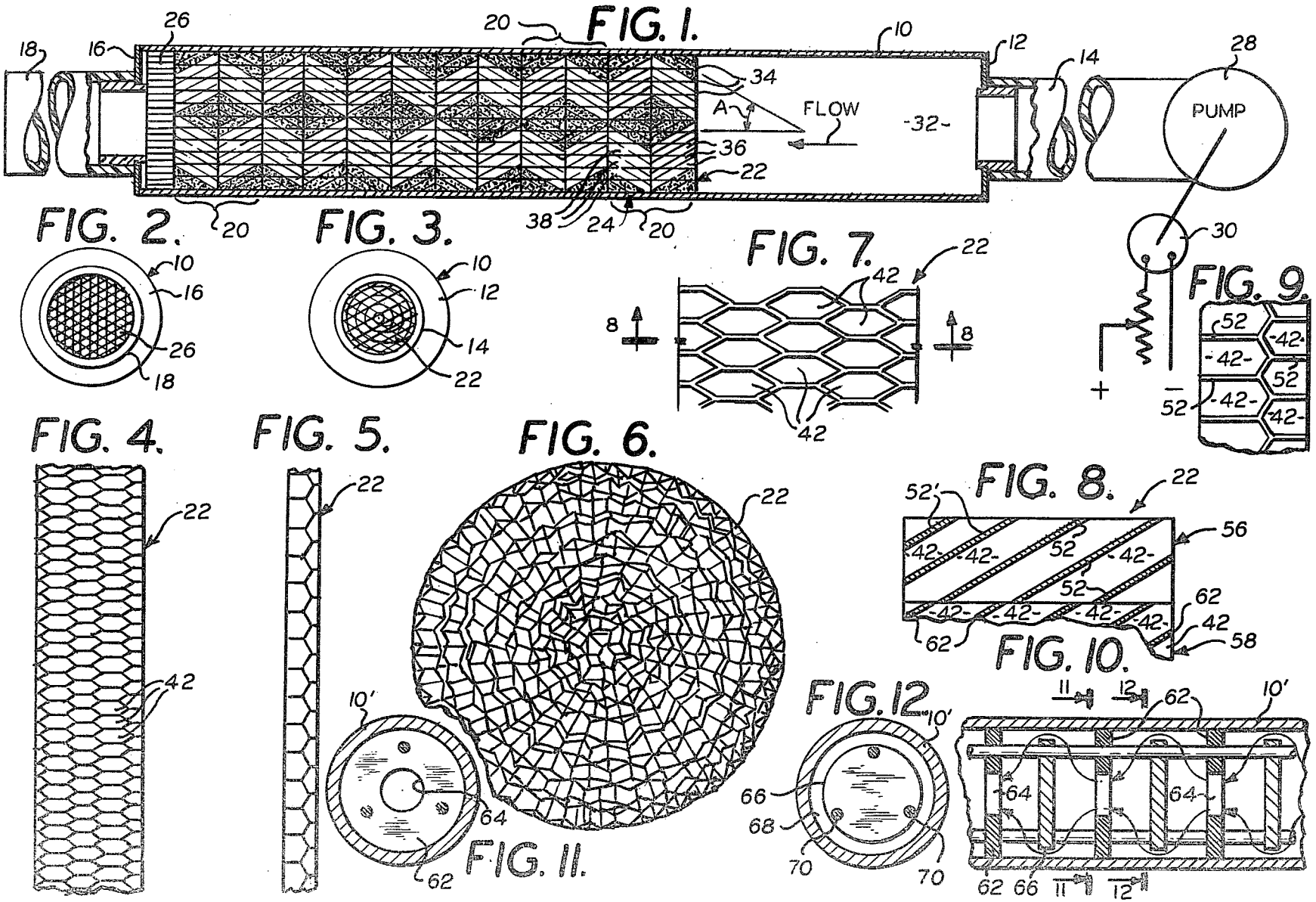
FIG. 1 is a diagrammatic view, mostly in section, showing a foamer constructed in accordance with this invention.
FIGS. 2 and 3 are sectional views taken on the lines 2—2 and 3—3, respectively, of FIG. 1.
FIG. 4 is a diagrammatic view of an expanded metal strip that is used to make the sections of the foamer of this invention.
FIG. 5 is an end view of the strip shown in FIG. 4.
FIG. 6 is an end view of one of the sections of the foamer made by wrapping the strip shown in FIGS. 4 and 5 into a spiral.
FIGS. 7 is an enlarged view of the structure shown in FIG. 4.
FIG. 8 is a sectional view taken along the line 8—8 of FIG. 7.
FIG. 9 is a greatly enlarged, fragmentary view of an edge portion of the strip shown in FIG. 5 and illustrating the structure of the cells with respect to one another.
FIG. 10 is a view showing a modification of the structure shown in FIG. 1.
FIGS. 11 and 12 are sectional views taken on the lines 11—11 and 12—12, respectively, of FIG. 10.

FIG. 1 shows the improved foamer of this invention with a cylindrical pipe section 10 with a wall 12 at its upstream end through which a supply pipe 14 opens. At the other end of the foamer pipe section 10, there is a wall 16 with an opening communicating with a foam discharge pipe 18. Within the pipe section 10, there are a plurality of mixing sections 20, six such sections being shown in FIG. 1.

Each mixing section 20 includes two coiled honeycomb strips 22 and 24 which are of the same construction but placed back-to-back so as to give the mixing section passages having successive outward and inward slopes.

At the discharge end of the pipe section 10, there is a straight honeycomb baffle 26 between the last mixing section 20 and the opening into the discharge pipe 18.

A mixture of water, air and surfactant are supplied to the upstream end of the foamer through the supply pipe 14 by a pump 28 driven by a variable speed motor 30. In the construction illustrated, there is a chamber 32 in the pipe section 10 and upstream from the mixing sections 20 for receiving the water, air and surfactant which constitute the ingredients from which the foam is made.

The construction of the coiled honeycomb strips 22 and 24 which make up the mixing sections 20 will be explained more fully in connection with other figures of the drawing, but FIG. 1 shows mixing sections which have been formed by winding a honeycomb strip into a spiral having six convolutions which touch one another along confronting spiral surfaces, some of which are indicated by the lines 34 in FIG. 1. The honeycomb openings in the strips 22 and 24 are not at right angles to the edges of the strips but extend diagonally, as shown by the sloping lines extending between opposite sides of the coil honeycomb strips, so as to leave openings in each successive layer of the strip in position to communicate with a honeycomb opening of the next successive layer. These openings do not accurately register with one another, but the openings are so large, with respect to the metal walls that surround the opening that communication between openings of successive layers is obtained without actual register of the honeycomb openings.

Because of the slope of the honeycomb openings in the coiled honeycomb strips 22 and 24, the openings not only communicate from one layer to the next in a radial direction but also open through opposite sides of the coiled honeycomb strips, and some of the sloping passages formed by this communication are indicated by the reference character 36 in FIG. 1. It will be apparent, therefore, that the openings 36 extend through the right-hand surface of the coiled strip 22 and travel along directions which diverge from the axis of the coiled strip 22; and at these passages 36 discharge to the left-hand side of the coil strip 22.

The coil strip 24 is preferably of identical construction with the coil strip 22, but it is oriented in the opposite direction so that passages corresponding to the passages 36 of coil strip 22 extend with a slope which is opposite to that in the coil strip 22. Some of the passages that converge toward the axis of the coil strip 24 are indicated by the reference character 38 in FIG. 1.

Not all of the sloping passages 36 and 38 communicate with one another. The slope of these passages causes some of them to open through the sides of the coiled honeycomb strips 22 and 24 and to open at their open ends through the circumference of the coiled strip so that they dead end into the inside surface of the cylindrical pipe section 10. Other passages that open through the faces of the coil strips 22 and 24 which confront one another dead end into corresponding passages on the opposite side of the center axis of the coiled strips. In order to make the operation of the foamer easier to understand, all of the passages which dead end into obstructions are stippled in FIG. 1 to indicate that they are not part of the passages through which the ingredients of the foam pass.

The passages marked with the reference characters 36 and 38, and the other passages which are not stippled, form the open portions of each mixing section 20 through which the ingredients for the foam pass and in which the pressure changes and turbulence of the foam ingredients cause them to form the small bubble foam.

The open passages 36 are of the same cross-section in each coil of the strip 22, but their circumferential extent becomes greater as they move toward the circumference of the coiled strip. This increases the cross-section of the passages 36. The increase in cross-section reduces the velocity of flow and increases the pressure on the fluid stream.

In the coiled honeycomb strip 24 which forms the second element of the mixing section 20, the openings 38 slope inwardly toward the axis of the coiled strip 24, so that each of the passages 38 decreases in cross-section as it extends in the direction of flow of the foam ingredients through the foamer. The velocity of the fluid stream increases as the cross-section decreases, and the increase in velocity decreases the pressure on the fluid stream. Thus, the fluid stream passing through the first section 20 and toward the foam discharge pipe 18, decreases in velocity and increases in pressure until it reaches the confronting faces of the coiled stips 22 and 24, and then increases in velocity and decreases in pressure until it reaches the next mixing section 20. This change in pressure promotes foaming; and the turbulence produced by the change in direction of flow further promotes foaming. The fact that the honeycomb openings in each layer of the coiled strips do not register accurately with the openings through adjacent layers at the confronting faces of successive coiled strips promotes further turbulence for promoting foaming of the ingredients.

The effect described for the first section 20 is repeated in the subsequent sections with more and more of the ingredients being foamed and with the size of the foam bubbles becoming smaller and smaller. At the discharge end of the last mixing section 20, the honeycomb 26 with the axially parallel passages provides for discharge from the sloping passages of the last mixing section 20 to the foam discharge pipe 18. FIGS. 2 and 3 show end views of the foamer.

FIG. 4 shows the strip 22 before it is rolled into a spiral. Such strips approximately on inch in width are available commercially, and a length of about 2½ feet is long enough to make a coil of about 3½ inches in diameter which is suitable for use in a foamer of the type shown in FIG. 1. Such honeycomb strips made of aluminum and various metals and plastics are commercially available. The honeycomb cells 42 are not hexagons in the commercially available strips when viewed at right angles to the surface of the strip. The actual cross-section of the cell in a plane at right angles to the longitudinal axis of the cell is approximately hexagonal in shape.

FIG. 7 shows a fragmentary portion of the strip of FIG. 4 on a greatly enlarged scale, so that the metal walls between the hexagonal cells 42 can be shown in double lines.

FIG. 8 is a sectional view taken on the line 8—8 of FIG. 7 and shows the way in which walls 52 of the hexagonal cells 42 slope at an angle to the broad faces of the strip 22.

FIG. 6 shows the way in which the strip 22 is coiled to form the first element of the mixing section 20 of FIG. 1. The coiled honeycomb strip 22 in FIG. 1, as previously explained, is shown with only five convolutions of the spiral, for clearer illustration, but actually, more convolutions are usually used for a foamer of substantial capacity. FIG. 6 shows a larger number of convolutions in the spiral illustrated.

FIG. 8 shows a layer 56 of the coiled honeycomb strip 22 overlying another layer 58, which is shown in fragmentary view. The honeycomb cells 42 are shown sloping downward toward the left in FIG. 8, and the cell walls of the layer 58 are indicated by the reference characters 62.

Because of the fact that a single strip 22 is wound in a spiral contour, as shown in FIG. 6, it is impossible to have the honeycomb cells 42 of the layer 56 (FIG. 8) register with the corresponding cells 42 of the next layer 58. At some locations around the spiral, such registration will occur by change but along most of the passages through which the fluid stream flows, the walls of the honeycomb cell of one layer will be out of registration with those of the next layer, as is illustrated by the layers 56 and 58 in FIG. 8. Cells on one layer overlap those on another, and cell walls 62 are in the line of flow through the cells 42 of the convolution 56. This is beneficial to the extent that it adds to the turbulence of the flow and promotes foaming.

The sloping honeycomb cells 42 of FIG. 8 are the passages 36 of FIG. 1 through which the fluid stream flows in a downward direction and with the radii of the passages 36 increasing in circumference as they extend toward the next coiled honeycomb strip 24.

FIG. 10 shows a tube 10' with baffles 62 located at spaced regions along the length of the tube 10'. Each of these baffles 62 has a center orifice 64. Alternating with the baffles 62 are other baffles 66 with annular or near annular orifices 68. The area of each orifice 68 is preferably two times the area of each orifice 64. The baffles 62 and 66 are held in spaced relation by rods 70 to which the baffles 62 and 66 are connected.

As air, water and surfactant travel lengthwise through the tube 10', the velocity of the stream varies and with it the pressure so as to cause the formation of a foam by the same principles as in FIG. 1, already described.

The illustrated embodiments of the invention provide an effective and economic way for making foam with small bubbles and capable of being transported for substantial distances to places of use for dust suppression and other purposes. Other structure operating on a similar principle can be constructed in other ways, and different combinations of the structure can be made, without departing from the invention as defined in the claims.

What is claimed is:

1. Apparatus for making foam from ingredients comprising air, water and surfactant, including pump means for supplying air, water and surfactant, mixing means connected to said pump means for mixing said ingredients and comprising a tubular chamber having a longitudinal axis and a plurality of discrete sections in successive relation lengthwise thereof, said sections comprising a first and second set of sections with the sections of each set alternating with one another, each of said sections of said first set having a multiplicity of passages formed by walls therein that commonly diverge from the longitudinal axis in a direction toward the downstream end of said chamber, and said multiplicity of passages increasing in cross-section as said passages diverge thereby causing said ingredients to diverge, each of said sections of said second set comprising a multiplicity of passages formed by walls therein that commonly converge toward the longitudinal axis in a direction toward the downstream end of said chamber, and said multiplicity of passages of said second set decreasing in cross-section as they converge thereby causing said ingredients to converge, walls of alternating sections being located to cause the flow to deflect at acute angles to the longitudinal axis of said chamber, with changes in cross-section resulting in changes in the velocity of flow and consequent changes in static pressure with resulting turbulence and foaming of said ingredients, and a delivery conduit for the foamed ingredients connected to the downstream end of said chamber and from which the foam is discharged to a place of use.

2. The apparatus described in claim 1 characterized by alternating sections of the passages being of substantially the same construction but facing in opposite directions to obtain the changes in passage direction from diverging to converging with respect to the direction of flow through the chamber.

3. The apparatus described in claim 1 characterized by each section having an axial length "l" and said plurality of passages extending at an angle "A" to the longitudinally axis of the chamber, the passages of the next section when said passages open through confronting ends of the sections at a distance from the longitudinal axis equal to "l tan A," and the passages that open through the end faces closer to the longitudinal axis dead heading with corresponding passages at the axis of the chamber.

4. The apparatus described in claim 1 characterized by some of the passages that discharge through only one side of their sections confronting corresponding passages of the next adjacent section and dead heading at the longitudinal axis of the sections and at the inside surface of a chamber wall that contacts with the outside circumference of the sections.

5. The apparatus described in claim 1 characterized by baffles in the passages through the sections that cause turbulence of the ingredients during their flow through each passage, including baffles that diverge from a center axis of the passage in the direction of flow of the ingredients, and other baffles that converge toward the center axis to change the cross section and velocity of flow alternately from flow with a component toward the longitudinal axis of the chamber to flow with a component away from the longitudinal axis of the chamber.

6. The apparatus described in claim 5 characterized by said walls being thin at the beginning and ends of the multiplicity of passages and some of which are slightly out of register with corresponding walls of adjacent sections to provide baffles that increase the agitation of foam and ingredients of the foam as they pass through the mixing chamber.

7. The apparatus described in claim 1 characterized by each of the sections being made of a length of material wrapped in spiral form and having openings therethrough that extend through an outer circumference of the spirally wrapped length of material and other openings that extend diagonally through the material at inner convolutions of the spiral.

8. The apparatus described in claim 7 characterized by each section having said length of material wrapped in a spiral with an inner face of each of the convolutions of the material adjacent to an outer surface of the next underlying convolution of the spiral.

9. The apparatus described in claim 7 characterized by the openings extending through both the circumferential outer surface of the spiral and the end faces of the spiral of material, said openings extending along parallel longitudinal axes of one another, but at an acute angle to the axis of the spiral.

10. The apparatus described in claim 1 characterized by the passages extending through a length of sheet material that is wrapped in a spiral and being made of metal and having passages that are openings of generally honeycomb cross-section separated by thin metal walls, said passages and walls providing the thickness of the convolutions of said spiral material.

11. The apparatus described in claim 10 characterized by the metal of the length of material being wound into a spiral and having its outer end portion shaped to merge the circumference of the spiral to a generally circular shape, and the sections being housed in the chamber with the circumference of each section in contact with the inside wall of the chamber.

12. The apparatus described in claim 1 characterized by each section being a length of the material that is a strip of substantially greater width than thickness and with a plurality of passages in parallel rows opening through the top surface of the strip and extending diagonally with respect to the top surface and down to the bottom surface through which the openings terminate except such openings as are close to the side edge of the strip and that open through the side edge thereof.

13. The apparatus described in claim 12 characterized by the openings being of generally polygon cross-section and extending through the strip at an angle of approximately 35° to the top and bottom surfaces of the strip, and said strip being fabricated of metal of approximately 2 to 10 mils thickness.

* * * * *